US006101939A

United States Patent [19]

Giori et al.

[11] Patent Number: 6,101,939

[45] Date of Patent: Aug. 15, 2000

[54] ROTARY PRINTING MACHINE FOR SECURITY PAPERS

[75] Inventors: Fausto Giori, Lausanne, Switzerland; Johannes Schaede, Wurzburg, Germany

[73] Assignee: De la Rue Giori S.A., Lausanne, Switzerland

[21] Appl. No.: 09/286,731

[22] Filed: Apr. 6, 1999

[30] Foreign Application Priority Data

Aug. 4, 1998 [CH] Switzerland ..... 837/98

[51] Int. Cl.[7] ..... B41F 5/16; B41F 5/18

[52] U.S. Cl. ..... 101/177; 101/181; 101/183

[58] Field of Search ..... 101/152, 153, 101/174, 175, 177, 179, DIG. 22, DIG. 49, 181, 248, 171, 178, 180, 216, 217, 229, 219–221

[56] References Cited

U.S. PATENT DOCUMENTS

| | | | |
|---|---|---|---|
| 4,009,660 | 3/1977 | Wells | 101/450 |
| 4,152,986 | 5/1979 | Dadowski et al. | 101/170 |
| 4,584,939 | 4/1986 | Giori | 101/152 |
| 5,009,156 | 4/1991 | Germann . | |
| 5,062,360 | 11/1991 | Germann et al. | 101/152 |
| 5,651,316 | 7/1997 | DeMoore et al. | 101/450.1 |

FOREIGN PATENT DOCUMENTS

| | | |
|---|---|---|
| 527 792 | 4/1954 | Belgium . |
| 0343105 | 11/1989 | European Pat. Off. . |

OTHER PUBLICATIONS

International Search Report In SN 0837/98.

*Primary Examiner*—Kimberly Asher
*Attorney, Agent, or Firm*—Bugnion S.A.; John Moetteli

[57] ABSTRACT

The web fed or sheet fed printing machine for security papers, in particular banknotes, possesses a principal printing group. It further has an additional, independent printing group (20) placed upstream of the principal printing group in the feed direction of the paper and allowing a pattern in at least one predetermined color to be printed over the entire width of the paper before the paper passes into the principal printing group.

7 Claims, 1 Drawing Sheet

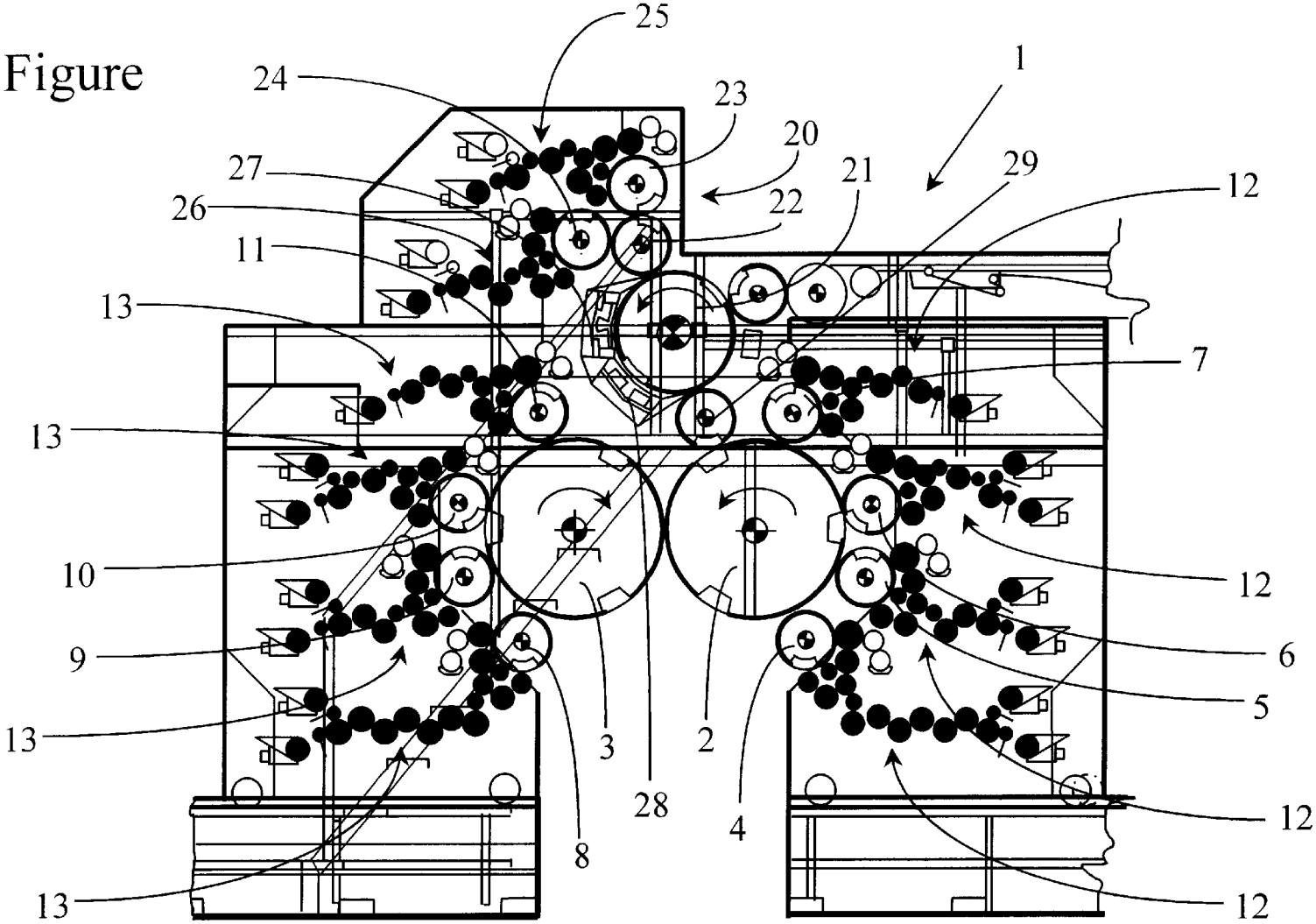
The Figure

ROTARY PRINTING MACHINE FOR SECURITY PAPERS

FIELD OF THE INVENTION

The invention relates to a web fed or sheet fed printing machine for security papers, in particular banknotes, comprising a principal printing group.

Such machines are known in the prior art. European patent application 0 132 858 (the content of which is incorporated by reference), for example, describes a machine allowing the paper to be printed on each side with an image having juxtaposed colors in accordance with a plurality of different printing processes, in particular in accordance with the process commonly known as "orlof-offset", or in accordance with the offset process. In "offset-offset" printing mode, each side of the sheet thus receives a multicolored impression by an offset process.

According to the known and disclosed offset process, the complete design is made up of partial designs in different colors carried by impression plates which are themselves mounted on plate cylinders which allow the superimposition of the designs and colors in register on a blanket cylinder against which the paper to be printed is then pressed. The number of impression plates, and consequently the number of plate cylinders, is equal to the number of different colors and designs making up the multicolored image to be printed. In the case of a simultaneous recto-verso printing machine, two blanket cylinders each receive a multicolored image, and the paper to be printed then passes between the two cylinders for the transfer of the images.

This machine comprises certain disadvantages, in particular the fact that the number of combinations of colors is limited by the size of the blanket cylinders and the bulk of the inking devices.

Another similar printing machine has been described in patent application EP 0 343 105, the content of which is incorporated by reference. This printing machine allows simultaneous recto-verso multicolor printing by the method commonly known as "orlof-offset". According to this method, a collector cylinder is inked by a plurality of color selector cylinders whose number is equal to the number of different colors of a given image. Each selector cylinder possesses areas cut out to form a relief which represents the parts of the image to be colored in a given color. The image applied to the collector cylinder by the selector cylinders is then transferred, via a plate cylinder, to a blanket cylinder which finally prints the image on the paper. For simultaneous recto-verso printing, use is thus made of two collector cylinders, one for each side of the sheet, with their own selector cylinders, and two blanket cylinders between which the paper passes and is printed. In a known manner, each recto or verso impression may comprise up to four different colors.

This known machine also comprises an additional device for inking one or other of the blanket cylinders, or even both simultaneously, in a manner such as to add an additional color to one or other of the faces of the paper and thus increase the security factor of the security papers eventually printed. This additional inking device comprises, in particular, a plate cylinder similar to the plate cylinder used in the "orlof-offset" process, which transfers the ink of a given color from the collector cylinder to the blanket cylinder. The additional inking device is placed beside the inking device already in place and transfers the ink to the existing blanket cylinders of the printing machine.

The disadvantage of this machine is that the number of printing possibilities, in particular the number of colors available, is always limited by the size of the blanket cylinders and by the bulk of the inking devices. Furthermore, the use of the blanket cylinders already in place limits the different printing techniques which could be used for the additional color or colors.

SUMMARY OF THE INVENTION

The object of the invention is to improve the machines known from the prior art.

More specifically, the object of the invention is to propose a printing machine making it possible to increase the possibilities for printing security papers, whether web fed or sheet fed, in a manner such as to improve the security factor thereof and to diversify possibilities for using different printing techniques and different colors. The forgery of security papers is thus rendered more complex and the resources needing to be employed by persons intending to forge security papers become more and more substantial.

The machine according to the invention is a machine comprising an additional, independent printing group placed upstream of the principal printing group in the feed direction of the paper and allowing a pattern in at least one predetermined color to be printed over the entire width of the paper before the paper passes into the principal printing group of the machine.

Several embodiments fall within the scope of the invention.

The additional printing group may use different known printing techniques, in particular offset printing, silk-screen printing or heliographic printing.

Preferably, the additional printing group is used to print security elements.

Furthermore, the additional printing group preferably possesses a drying unit comprising, for example, ultraviolet radiation lamps.

The advantages of this new machine are numerous: in particular, mention may be made of the fact that the additional group is completely modular, so that it can readily be installed on and become part of a printing machine already in use. Moreover, the printing process used in the additional group is not restricted to the same process already used in the printing machine in place, as taught by the prior art, but new combinations of printing processes are created. The diversification of the techniques and means employed also makes it possible to complicate the task of potential forgers.

Another advantage of this invention, apart from the fact that it allows the combination of several printing techniques and an increased number of colors, is the fact that the user has a choice, within a single machine, of printing processes without thereby needing a plurality of different machines. Thus, in a single pass and continuously, security papers whose security factor is greatly increased are produced in a simple and effective manner. Moreover, the type of inks used for a security paper may itself be varied since a plurality of different printing processes are possible.

Furthermore, there was also a prejudice in this technical field against adding such an additional printing group to the known machines. This was because it was considered that it was impossible to carry out prior printing onto paper before the paper had passed through a principal printing device, the risk being that the ink from the prior additional printing would be transferred to the cylinders of the principal group. Secondly, the system seemed very complex to produce and hence non-cost-effective. To the contrary, it has transpired that, in fact, this solution is entirely possible to implement in a relatively simple manner and that the drying effectively prevents the transfer of the ink from the paper to the cylinders of the principal group.

The invention will be better understood by virtue of the description of an embodiment thereof and the FIGURE relating thereto.

BRIEF DESCRIPTION OF THE DRAWING

The sole FIGURE is a lateral view in partial section of a printing machine whose principal printing group, by way of example, uses a simultaneous recto-verso multicolor offset printing process.

The invention will now be described with reference to this FIGURE.

DETAILED DESCRIPTION OF THE PREFERRED EMBODIMENT(S)

The simultaneous recto-verso offset printing machine 1 possesses, in a conventional manner, in its principal printing group, two blanket cylinders 2, 3 rotating in the direction indicated by the arrows and between which the paper passes to receive the multicolored impressions. The blanket cylinders 2, 3 receive the different patterns in their respective colors from plate cylinders 4, 5, 6, 7, 8, 9, 10 and 11 which are distributed around the circumference of said blanket cylinders 2, 3. These plate cylinders 4 to 11, carrying a relief plate, are themselves inked by the inking devices 12 and 13, respectively, in the manner customary in the prior art.

The additional printing group bears the general reference 20 and is placed upstream of the blanket cylinders 2, 3 in the direction of movement of the paper in the machine. As mentioned, this additional group may be designed to use various conventional printing techniques, in particular offset printing, silk-screen printing or heliographic printing. In the example described, the group is a two-color offset printing group which possesses an impression cylinder 21, a blanket cylinder 22, two plate cylinders 23 and 24 and two conventional inking devices 25 and 26. The plate cylinders 23, 24 on which the image to be printed is engraved in relief are inked by the rollers of the inking devices 25 and 26. The inked images are then transferred in register onto the blanket cylinder 22, and the complete image is transferred to the paper which passes between the blanket cylinder 22 and the impression cylinder 21, by the pressure of said impression cylinder on the blanket cylinder.

The ratio between the diameter of the impression cylinder 21 and the diameter of one of the blanket cylinders 2 or 3 of the principal printing group may be set at approximately ⅔. Such a ratio makes it possible to comply with two conflicting conditions: a diameter of the impression cylinder 21 which is sufficiently large to allow the complete drying of the additional print by means of the necessary number of lamps, but which is also sufficiently small to be able to be mounted in the printing machine.

The additional group shown thus makes it possible to add two patterns with one color each to the paper by means of the two plate cylinders 23 and 24.

Before passing between the two blanket cylinders 2, 3 of the printing machine and undergoing the printing process, the paper also passes through a drying device formed, for example, by means of ultraviolet radiation lamps 27, 28 which are placed around the impression cylinder 21. This device allows the drying of the freshly printed ink, which does not mix with the ink applied by the principal group.

Then the paper is brought to the blanket cylinders 2 and 3 of the principal printing group over a transfer cylinder 29 placed between the impression cylinder 21 of the additional unit 20 and the blanket cylinders 2 and 3. Because the additional printing group allows the use of various printing processes, it could also be used to print, simultaneously, a portion of the security background or a portion of the principal pattern of the security paper.

The invention is not restricted to the embodiment described, and variations are possible within the scope of the invention. For example, it is possible to add only a single additional color to the paper, or alternatively to add a color on each side of the paper. Furthermore, such an additional printing group can be installed in a machine whose principal printing group uses a printing technique other than offset, as described, for example an intaglio process, combinations of processes such as orlof-offset and orlof-intaglio, or alternatively a process applying optically variable units.

What is claimed is:

1. A web fed or sheet fed printing machine for security papers, in particular banknotes, comprising a principal printing group with a feed direction for paper of a certain width and at least a cylinder (2), wherein the machine comprises an additional, independent printing group (20) placed upstream of said principal printing group in the feed direction of the paper, said additional printing group comprising at least an impression cylinder and allowing a pattern in at least one predetermined color to be printed over the entire width of the paper before the paper passes into the principal printing group and wherein the diameter of the impression cylinder (21) of the additional printing group (20) is equal to ⅔ of the diameter of the cylinder (2) of the principal printing group.

2. The printing machine as claimed in claim 1, wherein the additional printing group (20) allows printing of two patterns, each in a predetermined color.

3. The printing machine as claimed in claim 1, wherein said machine comprises at least one drying unit (27, 28) for the ink, arranged around the impression cylinder (21) of the additional printing group.

4. The printing machine as claimed in claim 3, wherein the drying unit possesses ultraviolet radiation lamps (27, 28).

5. The printing machine as claimed in claim 1, wherein the additional printing group (20) is an offset printing group possessing at least one impression cylinder (21), a blanket cylinder (22), a plate cylinder (23, 24) and an inking device (25, 26).

6. The printing machine as claimed in claim 1, wherein the principal printing group is a simultaneous recto-verso multicolor offset printing group possessing a pair of blanket cylinders (2, 3), a group of a plurality of plate cylinders (4, 5, 6, 7, 8, 9, 10, 11) arranged along the periphery of the blanket cylinders, said plate cylinders each being inked by an inking device (12, 13) in a predetermined color and interacting with the blanket cylinders (2, 3) to superpose on said blanket cylinders (2, 3) the inked image from the plate cylinders (4, 5, 6, 7, 8, 9, 10, 11).

7. The printing machine as claimed in claim 6, wherein said machine possesses only a single transfer cylinder (29) between the impression cylinder (21) of the additional unit (20) and the blanket cylinder (2) of the principal printing group.

* * * * *

UNITED STATES PATENT AND TRADEMARK OFFICE

CERTIFICATE OF CORRECTION

PATENT NO. : 6,101,939
DATED : August 15, 2000
INVENTOR(S) : Giori et al.

It is certified that error appears in the above-identified patent and that said Letters Patent is hereby corrected as shown below:

Title page,
Item [30] Foreign Application Priority Data "Aug.1998 by -- April 8, 1998 --.

Signed and Sealed this

Twenty-first Day of August, 2001

*Attest:*

Nicholas P. Godici

NICHOLAS P. GODICI
*Acting Director of the United States Patent and Trademark Office*

*Attesting Officer*